United States Patent [19]

Shagarova et al.

[11] Patent Number: 4,728,047

[45] Date of Patent: Mar. 1, 1988

[54] SEPARATOR-DISINTEGRATOR

[76] Inventors: Bella U. Shagarova; Olev G. Reemet, both of ulitsa Mustamvae, 149, kv. 113; Ott F. Alasoo, bulvar Svpruse, 198, kv. 87; Mart A. Perv, ulitsa Pukhkekodu, 63, kv. 11, all of Tallin, U.S.S.R.

[21] Appl. No.: 905,559

[22] Filed: Sep. 10, 1986

[51] Int. Cl.[4] ..... B02C 13/286

[52] U.S. Cl. ..... 241/79.1; 241/80; 241/188 R

[58] Field of Search ..... 241/79.1, 80, 188 R, 241/188 A, 277, 97, 186.2, 186.3, 186 R

[56] References Cited

U.S. PATENT DOCUMENTS 4,093,127 6/1978 Alberts et al. ..... 241/55

FOREIGN PATENT DOCUMENTS 689936 4/1953 United Kingdom ..... 241/188 A 938236 6/1982 U.S.S.R. .

8504822 7/1985 U.S.S.R. ..... 241/188 A

*Primary Examiner*—Mark Rosenbaum

*Attorney, Agent, or Firm*—Lilling & Greenspan

[57] ABSTRACT

A separator-disintegrator includes a casing accommodating a rotor, a rotor drive, a pipe to charge material to be separated and pipes to discharge fine and coarse fractions of material. The rotor is embraced by an annular chamber installed in the casing and facing the rotor with its open portion. An inner space of the chamber makes up a material separation zone. Side walls of the chamber have openings to communicate the chamber with the pipe to discharge fine fraction of material. The pipe to discharge coarse fraction of material, which communicates with the chamber, has a damper mounted for longitudinal movement.

5 Claims, 8 Drawing Figures

SEPARATOR-DISINTEGRATOR

BACKGROUND OF THE INVENTION

1. Field of the Invention

The present invention relates to means for separating solid materials with the use of gas or air flows and, more particularly, to separators-disintegrators.

The invention may effectively be used in production of fillers, in chemical, coal, construction and other industries.

2. Description of the Prior Art

There is known in the art a disintegrator and separator apparatus (cf. USSR Inventor's Certificate No. 938,236, IPC B 02 C 13/22), which comprises contra-rotating rotors having disks with rows of grinding elements secured thereon, transport circles for coarse and fine fractions having respective outlet pipes, forced-draught fan blades to augment a separating air flow. A material separation zone is disposed between the subsequent processing circle and the transport circle. To isolate circular passages for discharging coarse and fine fractions of the material from one another, a partition is provided.

The pulverized material arrives into the separation zone wherein a transverse air flow is generated by the forced-draught fan blades which carries the fine fraction through openings of the transport circle to the circular passage. Coarser particles continue to move by inertia in a radial plane and go through the circular passage to the inlet pipe to undergo the repeated grinding. Such a separator employed in the disintegrator has a rather complicated design and requires additional energy to transport fine and coarse fractions of the material and what is most essential fails to provide a substantially effective separation of the material into fractions as the material is supplied to the separation zone at a great speed with the fractions being intermixed. Moreover, the possibility of producing an adequate draught to draw the fine fraction into a conveyor is limited since it is built in the disintegrator and is limited by the dimensions thereof.

Also known in the art is a separator-disintegrator (cf. U.S. Pat. No. 4,093,127) comprising a casing with a rotary impeller accommodated therein, a rotary impeller drive, an inlet pipe to charge material to be separated and outlet pipes to discharge fine and coarse fractions of the material. The rotary impeller has back and front disks connected by transverse blades normal to the direction of rotation of the impeller. Secured inside the casing are impact plates making up a central (internal) compartment and an external compartment having pipes to return coarse fraction of the material to the central compartment.

The material is accelerated by means of the blades secured on the disks and strikes against the stationary impact plates arranged with a clearance with respect to each other to be disintegrated into particles which chaotically scatter in the external compartment and partially return into the central compartment. The disks with blades alongside with charging the material force air which draws the fine fraction through the clearances between the impact plates into the external compartment and then into the pipe.

When being disintegrated by impact the particles of final product of different size have no speed specific only for a certain size. Chaotic scattering of the particles and unequal speeds of particles of the same size at a uniform air draught make it impossible to provide exact sizing of the particles and highly-efficient separation.

SUMMARY OF THE INVENTION

An object of the invention is to enhance the efficiency of separation of material being separated.

The object is accomplished by that in a separator-disintegrator comprising a casing accommodating a rotor embraced by an annular chamber installed in the casing, disposed in close proximity to and facing the rotor with its open portion, a rotor drive, a pipe to charge material to be separated and pipes to discharge fine and coarse fractions of the material according to the invention side walls of the annular chamber are provided with openings through which the chamber communicates with the pipe to discharge fine fraction of the material, and one of the pipes to discharge coarse fraction of the material communicates with the chamber and has a damper mounted for longitudinal movement.

The chamber in the longitudinal section may have constant dimensions parallel to the rotor axis.

The chamber in the longitudinal section may have changing dimensions parallel to the rotor axis.

The chamber in the longitudinal section may have dimensions parallel to the rotor axis continuously changing.

The chamber in the longitudinal section may have dimensions parallel to the rotor axis changing in steps.

The separator-disintegrator according to the invention features high efficiency in separating the material into predetermined grain sizes.

BRIEF DESCRIPTION OF THE DRAWING

The invention will be further described, by way of example, with reference to the accompanying drawings, in which.

DESCRIPTION OF THE PREFERRED EMBODIMENTS

Figure 1:
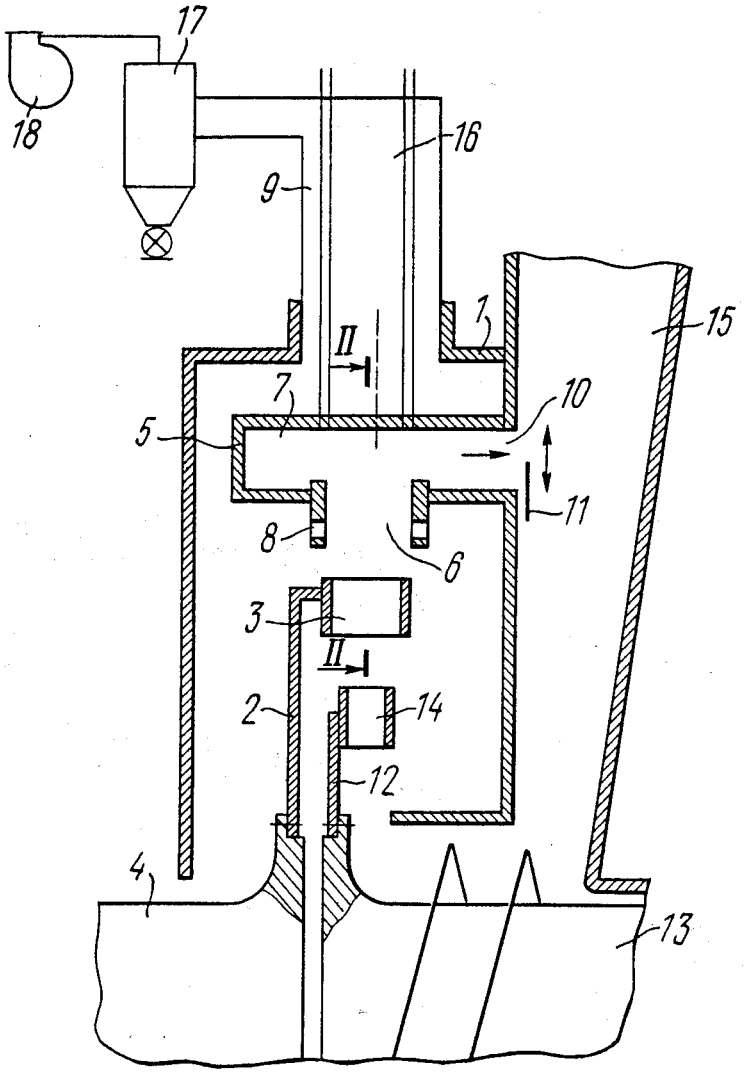
FIG. 1 is a general view of a separator-disintegrator according to the invention, in longitudinal section.

A separator-disintegrator comprises a casing 1 (FIG. 1) with a rotor accommodated therein and having a disk 2 peripherally mounting blades 3. The disk 2 is mounted on a shaft 4 of a drive. The rotor is embraced by an annular chamber 5 positioned in the casing 1 in close proximity to the rotor and facing the blades 3 of the rotor with its open portion 6. An inner space 7 of the chamber 5 makes up a material separation zone. Side walls of the chamber 5 have openings 8 (FIGS. 1, 2) by mens of which the chamber 5 is communicated with an outlet pipe 9 to discharge fine fraction of material. Also communicated with the chamber 5 (FIG. 1) is an outlet pipe 10 to discharge coarse fraction of material. The outlet pipe 10 has a damper 11 mounted for longitudinal movement. The separator-disintegrator may have a second rotor comprising a disk 12 mounted parallel with the disk 2 on a shaft 13 of the drive and having a diameter smaller than the diameter of the disk 2, and blades 14 arranged along the periphery of the disk 12 opposite to the blades 3 of the first rotor.

The separator-disintegrator has an inlet pipe 15 intended to charge material to be separated and communicating with the outlet pipe 10, and an outlet pipe 16 to discharge coarse fraction of the material from the device. The outlet pipe 9 to discharge fine fraction of the material from the device communicates with a dust collector, for example, with a cyclone 17, and employs a draught produced by, for example, a fan 18.

Figure 2:
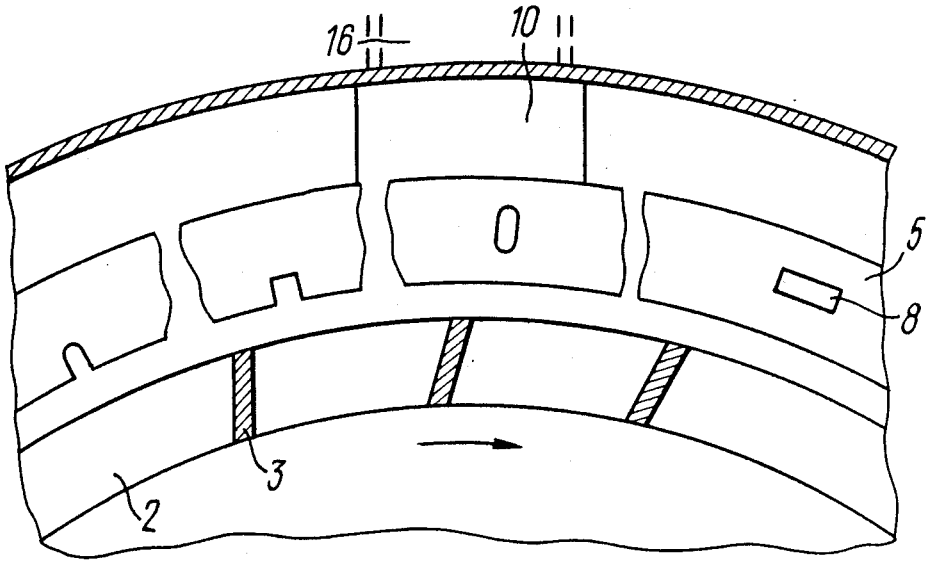
FIG. 2 is a section on the line II—II in FIG. 1 according to the invention.
Figure 3:
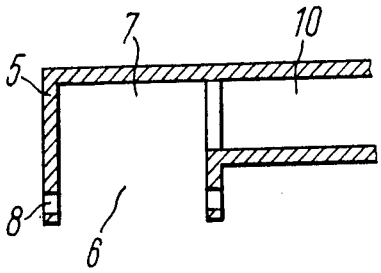
FIG. 3 shows an embodiment of the chamber defining a material separation zone, dimensions of which in the longitudinal section parallel to the rotor axis are constant according to the invention.
Figure 6:
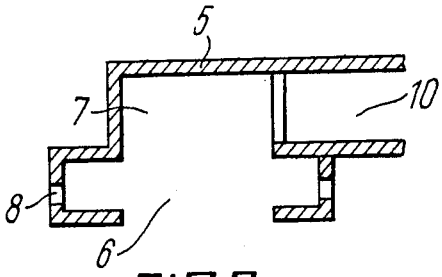
FIG. 6 shows an embodiment of a chamber defining a material separation zone, dimensions of which in the longitudinal section parallel to the rotor axis are changing in steps according to the invention.
Figure 4:
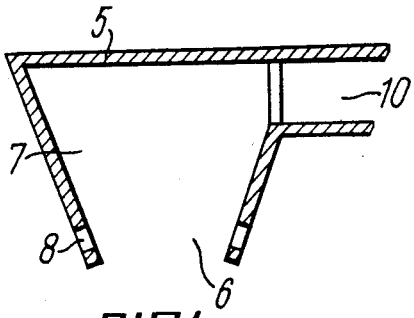
FIG. 4 shows an embodiment of a chamber defining a material separation zone, dimensions of which in the longitudinal section parallel to the rotor axis are continuously changing according to the invention.
Figure 7:
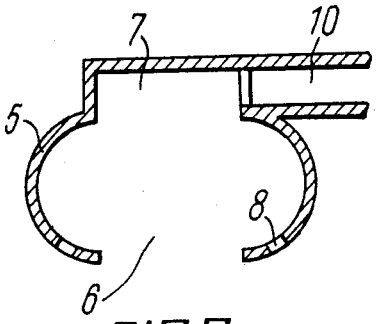
FIG. 7 shows another embodiment of a chamber defining a material separation zone, dimensions of which in the longitudinal section parallel to the rotor axis are continuously changing according to the invention.
Figure 5:
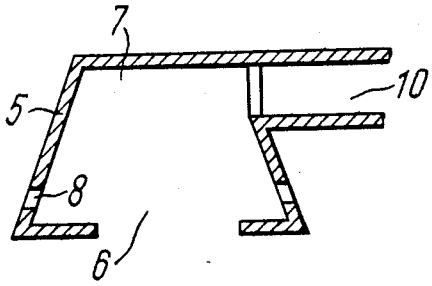
FIG. 5 shows another embodiment of a chamber defining a material separation zone, dimensions of which in the longitudinal section parallel to the rotor axis are continuously changing according to the invention.
Figure 8:
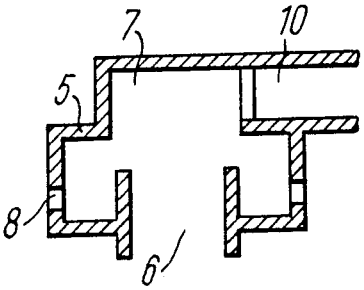
FIG. 8 shows a third embodiment of a chamber defining a material separation zone, dimensions of which in the longitudinal section parallel to the rotor axis are changing in steps according to the invention.

The chamber 5 defining the material separation zone may have various designs. The chamber 5 in the longitudinal section may have constant dimensions (FIG. 3) or dimensions changing continuously (FIGS. 4, 5) or in steps (FIGS. 1, 6, 7, 8) in the direction parallel to the rotor axis. The openings 8 (FIG. 2) may be made in a wider portion of the chamber 5 (FIGS. 5, 6, 7, 8) and also in a narrower portion thereof (FIGS. 1, 4).

The separator-disintegrator operates as follows. The material to be separated arrives together with a gas flow, for example, with an air flow, through the inlet pipe 15 (FIG. 1) to the rotor which accelerates the material and flings it into the chamber 5 with the aid of blades 3. Particles of the material of different size enter the chamber 5 at equal speeds. While moving in the chamber 5 in a dust or air medium the particles encounter resistance of the medium and depending on the time of their travel in the chamber 5 away from the rotor the separation of the particles depending on their size is started. Smaller particles lose their initial energy to a greater extent than larger particles, therefore the stream of material is separated into layers by particle sizes. Due to regulation of the draught produced by the fan 18 the air flow is drawn off through the openings 8 at a definite speed and as a result a predetermined fraction of the material is carried away from the chamber 5. When the material previously separated into layers is carried away from the chamber 5 the collision of particles of different size is highly improbable and this results in a very efficient separation of the material by the predetermined limiting grain. The chamber 5 embodied as shown in FIGS. 1, 3, 4 ensures separation by a smaller limiting grain since in a narrower portion of the chamber 5 (FIGS. 1 and 4) or in the chamber 5 (FIG. 3) having a constant section the velocity head is maintained with the air flow trajectory not changing, which results in a loss of energy by very fine fractions of the material and in the separation thereof. In the chamber 5 embodied as shown in FIGS, 5, 6, 7, 8 due to a sudden widening of its inner space 7 the air flow changes its trajectory on entering the chamber 5 with a simultaneous drop in the velocity head, which allows separation of the material featuring a great size of limiting grain.

The position of the openings 8 (FIG. 2) in the side walls of the chamber 5 depends on the initial speed of the material entering the chamber 5 and on the particle sizes by which the material is separated, whereas the size of the openings 8 depends on the difference in energy losses between the particles of different size.

The embodiments having the chamber 5 with the openings 8 (FIGS. 5, 6, 7, 8) made in the wider portion thereof are used to separate material by a greater limiting grain, whereas those having the chamber 5 (FIGS. 1, 4) with the openings 8 made in the narrower portion thereof are used to discharge finer fractions of the material.

The design and volume of the chamber 5 (FIG. 1) are selected depending on the volume of air to be forced therein and on the preferred manufacturing methods.

The drawn off fine fraction is carried through the outlet pipe 9 to the dust collector 17 to be discharged therefrom. Coarse fraction of the material returns through the outlet pipe 10 for repeated grinding or is discharged from the outlet pipe 16 if it is necessary to divide the material into two fractions by size of particles or to divide the material into fractions of different strength.

Pressure in the chamber 5 is regulated by means of the damper 11 which changes the discharge area.

The separator-disintegrator of the hereinabove disclosed construction wherein the separation zone is defined by the chamber makes it possible to perform a highly effective separation of material within a wide range of sizes of limiting grain with discharging fine fraction. Absence of moving elements in the construction ensures its reliability. When the separating chamber is installed, for example, in disintegrators and crushers above the last row of grinding elements, use is made of a velocity head produced by them and energy of the material thrown by them into the chamber 5 thereby decreasing the total amount of energy consumed in the separating process.

What is claimed is:

1. A separator-disintegrator comprising:

a casing;

a rotor accomodated in said casing;

a drive of said rotor;

an annular chamber positioned in said casing in close proximity to and embracing said rotor, an open portion of said annular chamber facing said rotor so as to define a separation zone in said annular chamber, side walls of said annular chamber having openings;

an outlet pipe to discharge fine fraction of material communicating with said annular chamber by means of said openings in said side walls;

at least one of a first pipe or a second pipe to discharge coarse fraction of material communicating with said annular chamber;

a damper mounted in each of said at least one of said first or second pipes for discharging coarse fraction of material and capable of longitudinal movement; and an inlet pipe to charge material to be separated, being in communication with said first pipe for discharging coarse fraction of material.

2. A separator-disintegrator as claimed in claim 1 wherein said annular chamber in the longitudinal section has constant dimensions parallel to the axis of said rotor.

3. A separator-disintegrator as claimed in claim 1 wherein said annular chamber in the longitudinal section has changing dimensions parallel to the axis of said rotor.

4. A separator-disintegrator as claimed in claim 3 wherein said annular chamber in the longitudinal section has said dimensions continuously changing.

5. A separator-disintegrator as claimed in claim 3 wherein said annular chamber in the longitudinal section has said dimensions changing in steps.

* * * * *